US009808957B2

(12) United States Patent
Scherer et al.

(10) Patent No.: US 9,808,957 B2
(45) Date of Patent: Nov. 7, 2017

(54) MOULD FILLING METHOD

(75) Inventors: Ronald J. Scherer, Crossville, TN (US); Leonard Browning, Aurora, IL (US); Robert J. Lundell, Stillwater, MN (US); Steven E. Hinde, New Hartford, IA (US)

(73) Assignee: Oldcastle Architectural, Inc., Atlanta, GA (US)

( * ) Notice: Subject to any disclaimer, the term of this patent is extended or adjusted under 35 U.S.C. 154(b) by 913 days.

(21) Appl. No.: 13/575,120

(22) PCT Filed: Jan. 21, 2011

(86) PCT No.: PCT/US2011/021973

§ 371 (c)(1),
(2), (4) Date: Nov. 6, 2012

(87) PCT Pub. No.: WO2011/094118

PCT Pub. Date: Aug. 4, 2011

(65) Prior Publication Data

US 2013/0049260 A1 Feb. 28, 2013

Related U.S. Application Data

(60) Provisional application No. 61/298,323, filed on Jan. 26, 2010.

(51) Int. Cl.
*B28B 13/02* (2006.01)
*B28B 1/29* (2006.01)

(52) U.S. Cl.
CPC ..... *B28B 1/29* (2013.01); *B28B 13/023* (2013.01); *B28B 13/0255* (2013.01); *B28B 13/0295* (2013.01)

(58) Field of Classification Search
CPC .... B28B 13/0295; B28B 1/29; B28B 13/0255
See application file for complete search history.

(56) References Cited

U.S. PATENT DOCUMENTS 2,686,950 A * 8/1954 Zevely ..... 425/162
3,397,435 A * 8/1968 Jelesiewicz ..... B28B 13/023 425/225

(Continued)

FOREIGN PATENT DOCUMENTS

EP 0262278 A1 4/1988
EP 1122046 A1 8/2001

(Continued)

OTHER PUBLICATIONS

International Preliminary Report on Patentability for PCT/US2011/021973 dated Jul. 31, 2012.

(Continued)

*Primary Examiner* — Matthew Daniels
*Assistant Examiner* — Patrick Butler
(74) *Attorney, Agent, or Firm* — Merchant & Gould P.C.

(57) ABSTRACT

A method of filling a mold with a settable material, such as a cementitious mixture, is disclosed. The mold includes a plurality of cavities that open to a top face of the mold, and is suitable for forming building elements, such as pavers, for covering surfaces. The method includes providing an additional volume per unit area of settable material to at least part of selected ones of the cavities, and compacting the settable material in at least part of all of the cavities, including the additional volume per unit area of settable material provided to the selected ones of the cavities, to substantially the same thickness. A mold and a scraper suitable for use in the method are also disclosed.

13 Claims, 14 Drawing Sheets

(56) References Cited

U.S. PATENT DOCUMENTS

| | | | | |
|---|---|---|---|---|
| 3,568,272 | A | 3/1971 | Zmania | |
| 5,114,637 | A | 5/1992 | Williams et al. | |
| 5,395,228 | A | 3/1995 | Aeseth et al. | |
| 5,827,015 | A | 10/1998 | Woolford et al. | |
| 5,922,266 | A | 7/1999 | Grove | |
| 6,468,065 | B1 | 10/2002 | Butler | |
| 2009/0224425 | A1 | 9/2009 | Ness | |
| 2010/0007051 | A1* | 1/2010 | Ness et al. | 264/299 |

FOREIGN PATENT DOCUMENTS

| | | | |
|---|---|---|---|
| GB | 588856 | * | 6/1947 |
| JP | H06285695 | A | 10/1994 |
| WO | WO98/23424 | A2 * | 6/1998 |
| WO | 2009015441 | A1 | 2/2009 |
| WO | 2010141686 | A1 | 12/2010 |
| WO | 2010141705 | A1 | 12/2010 |

OTHER PUBLICATIONS

Search Report for PCT/US2011/021973 dated May 10, 2011.
Supplementary European Search Report for Application No. 11737463.7 dated Jan. 22, 2014.

* cited by examiner

MOULD FILLING METHOD

The present invention relates to a method of, and apparatus for, filling or charging a mould with a cementitious material. In particular, but not exclusively, the invention relates to a method of filling a mould having a plurality of cavities, for example of different sizes, and to an apparatus for use in such a method.

It is often desirable to provide interior and exterior surfaces such as floors, walkways, driveways, patios, work surfaces and so on with a covering, for example to enhance the durability and wear resistance of the surface, to adapt the surface for a particular use, and/or for aesthetic reasons.

Many types of covering are known in the art. One of the most popular and convenient types of covering involves laying a plurality of building elements in a two-dimensional arrangement across the surface. Such building elements may include, for example, flagstones, stones, bricks, pavers, tiles, blocks and the like.

The building elements may be of natural materials, such as stone or slate, or of man-made materials, such as cementitious materials. Typically, cementitious materials consist of mixtures of fine and coarse aggregates, cement, pozzolan, water, admixtures and so on. The use of cementitious materials in such building elements can offer several advantages compared to natural materials, including lower cost, convenient availability, lower density, better and more consistent mechanical performance, durability, appearance and so on. Cementitious materials are also used in the manufacture of building elements for purposes other than surface coverings, such as for walling, cladding, roofing, retaining walls and landscaping.

A building element can be manufactured from a cementitious material by filling a cavity in a suitable mould with a casting mix of the material. The cavities open to top and bottom faces of the mould. During filling, the mould is set onto a pallet, so that the cavities at the bottom face of the mould are closed by the pallet. After filling, the mould is removed or lifted to leave self-supporting blocks of mix on the pallet. The casting mix is then allowed to harden and/or cure to form the building elements. The finished building element therefore takes its form from the shape of the cavity. Usually, a mould having a plurality of cavities is used, so that a plurality of building elements can be manufactured simultaneously.

Typically, the casting mix of a cementitious material includes a granular component, such as an aggregate, with a relatively large particle size. Furthermore, casting mixes often have a relatively low water content, so that the mix is self-supporting after removal of the mould and so as reduce the amount of shrinkage that takes place as the mix cures. Consequently, the casting mix has a relatively high viscosity, and may be described as a semi-dry or earth-dry mix. Throughout this specification, the terms 'casting mix' and 'mix' will be used to refer to the cementitious material in its castable form, before curing of the mix takes place.

It is commonplace during filling of the mould to vibrate the mould in order to encourage the casting mix to fill all of the space in the cavity. Also, after filling, the casting mix is usually tamped or compacted in the mould by applying pressure from above, again with vibration. The aims of these processes are to ensure that the density of the casting mix in the cavity is uniform, and to eliminate, as far as possible, any porosity in the mix before hardening takes place.

A typical casting mix may comprise approximately 30-50% aggregate with a particle size of approximately 8 mm to 4 mm, approximately 30-50% aggregate or sand with a particle size of approximately 4 mm or less, approximately 5-30% cement, approximately 5-30% of a cement replacement material such as coal burning fly ash, minor additions such as pigment, admixtures and the like, and water to achieve the desired workability.

In some cases, building elements for surface coverings are regular in shape, and are arranged into a repeating pattern or array during laying of the surface covering. The joints between adjacent elements, which may be filled with mortar or other materials, contribute to the appearance of the surface covering along with the exposed surfaces of the elements themselves.

It is common to provide elements of a particular type in several different sizes, so as to allow arrangement of differently-sized elements to provide a visually appealing pattern. Consequently, when manufacturing elements of a given material, colour and surface finish, it is desirable to produce elements in several different sizes in the same process.

It is also becoming increasingly common to lay pavers and other surface covering elements by mechanised means. Compared to manual laying, mechanised laying of pavers can be quicker, safer and less labour-intensive. Typically, an area of surface of approximately one square meter or one square yard is covered by lifting and placing a pre-arranged set of elements on to the suitably-prepared surface.

To avoid the need to sort and arrange elements of different sizes into a set suitable for mechanical installation after manufacture of the elements, it is advantageous if the elements are manufactured in the correct pattern. For example, FIGS. 1 and 2 of the accompanying drawings show, respectively, a perspective view and a top view of a plurality of pavers 100 arranged in a set 102. The pavers 100 in the set 102 are arranged in a pattern suitable for laying mechanically. As is known in the art, the set 102 of pavers 100 is manufactured in a single manufacturing process.

In this example, the set 102 consists of pavers 100 of three different sizes. The smallest-size pavers 100, labelled "01" in FIG. 1, have a top face area of approximately 87 mm by 174 mm. The mid-sized pavers 100, labelled "02" in FIG. 1, have a top face area of approximately 174 mm square. The largest-size pavers, labelled "03" and "04" in FIG. 1, have a top face area of approximately 174 mm by 260 mm.

Each paver 100 is provided with spacers 104 that can be used to set a gap of a pre-determined size between the top faces 106 of adjacent pavers 100, when laid. This helps to achieve a uniform joint appearance between the pavers 100. As shown most clearly in FIG. 1, the spacers 104 take the form of laterally-directed extensions or pads on the vertical faces of the pavers 100. The spacers 104 taper towards the top faces of the pavers 106, so that the spacers 104 do not extend to the top faces 106. In this way, when the pavers 100 are installed and the joints are filled with mortar, sand or a similar material, the spacers 104 are not visible.

A known manufacturing process for producing a set of pavers such as that shown in FIGS. 1 and 2 will now be described. FIG. 3 shows, schematically and in side view, a series of stages in the manufacturing process.

The pavers are cast using a mould 108, shown in cross-section in FIGS. 3(*a-e*). The mould 108 includes a plurality of cavities 110. The cavities 110 are open to the top surface 112 of the mould 108. The cavities are also open to the bottom surface 113 of the mould 108. In use, the mould sits on a pallet (not shown in FIGS. 3(*a-e*)) which closes the cavities at the bottom face 113. In this way, the cavities are arranged to receive and retain a casting mix of cementitious material. The length and width dimensions of each cavity correspond to the required length and width of the pavers.

Consequently, adjacent cavities 110 in the mould 108 can have different length and width dimensions. All of the cavities 110 have the same depth.

The mould 108 is arranged in a machine having a feed drawer 114, shown from the side in FIGS. 3(*a-e*). The feed drawer 114 is mounted so that it can travel back and forth in a filling direction (indicated by arrow F in FIG. 3(*a*)) across the top surface 112 of the mould 108, whilst leaving a small gap between the top surface 112 of the mould 108 and the bottom of the feed drawer 114. The feed drawer 114 is fed with a casting mix of cementitious material 116 from a hopper (not shown).

FIG. 3(*a*) shows a starting position of the feed drawer 114, before mould filling takes place. To fill the cavities 110 of the mould 108, the feed drawer 114 is moved relative to the mould 108 so that the bottom of the feed drawer 114 overlies the mould 108. In FIG. 3(*b*), the feed drawer 114 is shown moving from left to right across the mould 108. The cementitious mix 116 is able to pass through the bottom of the feed drawer 114 onto the top surface 112. For example, the bottom of the feed drawer 114 may be in the form of a perforated, slotted or mesh plate.

The mix 116 therefore flows from the feed drawer 114 into the cavities 110 and onto the top surface 112 of the mould 108, as shown in FIG. 3(*b*).

The front edge of the feed drawer 114, shown on the right in FIG. 3, is fitted with a scraper 120. The scraper 120 consists of a strip of typically metal, rubber or plastics material, mounted to the feed drawer 114 along a top portion and having a lower portion that extends to the top surface 112 of the mould 108. The scraper 120 may be biased towards the top surface 112, for example by a biasing arrangement such as an array of springs, or through the resilience of the material from which the scraper 120 is made. The back edge of the feed drawer 114, shown on the left in FIG. 3, includes a retaining bar 118 that extends downwardly towards the mould 108.

FIG. 3(*c*) shows a fully forward position of the feed drawer 114 after it has moved to the right. In this position, the retaining bar 118 and the scraper 120 act as retaining means to prevent the mix 116 from spilling from the feed drawer.

Once the feed drawer 114 has traveled to its fully forward position over the mould 108, as shown in FIG. 3(*c*), all of the cavities 110 are filled with the mix 116. The feed drawer 114 is then moved back across the mould 108, as shown in FIG. 3(*d*).

The scraper 120 is a sliding fit against the top surface 112 so that, when the drawer 114 moves back across the mould 108, the scraper 120 is drawn along the top surface 112 to clear or scrape excess mix from the mould 108. The scraper 120 also levels the mix 116 in the cavities, so as to ensure that the mix 116 in each cavity 110 does not protrude beyond the top surface 112 of the mould. This is important in ensuring that the correct amount of mix 116 is retained in each cavity 110.

As the mix 116 settles in the cavities 110, aided by vibration of the mould 108 during the filling process, the level of the mix 116 in the cavities 110 tends to drop away from the top surface 112 of the mould 108. To add more mix 116, the feed drawer 114 may be passed over the mould 108 one or more additional times, to repeat the steps shown in FIGS. 3(*b*) to 3(*e*). With each such pass, more casting mix 116 is transferred from the feed drawer 114 onto the top surface 112 of the mould 108 and into the cavities 110. The scraper 120 on the rightmost side of the feed drawer 114 again scrapes the excess mix 116 from the top surface as the drawer 114 returns to its starting position.

Once the cavities 110 in the mould 108 have been sufficiently filled with mix 116, the mix is tamped or compacted to increase the density of the mix by the application of a tamping device (not shown). The tamping device includes a plurality of fitted tamping plates or fitted shoes having the same in-plane dimensions and arrangement as the cavities 110 in the mould 108. The tamping shoes are pressed on to the mix 116 in each cavity 110 and vibrated so as to compact the material 116.

After tamping, the mould 108 is removed by lifting the mould 108 upwardly to separate it from the pallet, leaving the pavers in place on the pallet. Conveniently, the tamping shoes remain on top of the mix 116 in each cavity 110 while the mould 108 is removed. The pavers then undergo a hardening or curing process before packaging for transportation or storage. Preferably, the pavers remain in the arrangement in which they were cast until they are laid.

To achieve adequate strength in the finished pavers, it is important that the cementitious casting mix 116 is packed into the mould cavities 110 to a sufficiently high density to reduce the number and size of defects such as pores in the product to an acceptable level. In this way, the casting mix 116 forms highly compacted and dense units.

It has been observed that, when using the process of FIG. 3 to manufacture a plurality of differently-sized pavers or other building elements simultaneously, such as the set 102 of pavers 100 shown in FIGS. 1 and 2, the smallest size of pavers 100 tend to be more susceptible to breakage than the larger sizes of pavers 100. It has been determined that the cementitious mix 116 packs to a lower density in the small pavers 100 than in the large pavers 100 when subjected to the same manufacturing conditions.

One explanation for this phenomenon is that the small pavers 100 have a greater edge-to-surface area ratio than the larger pavers 100. The filling of relatively coarse aggregate in the mix 116 is constrained by the edges of the corresponding cavities 110, and so the average density of the mix 116 after compaction is lower in the small pavers where the edges have greater relative influence on the geometry.

Furthermore, when the pavers 100 are provided with spacers 104 that project from the edges of the pavers 100, corresponding recesses must be provided in the mould cavities 110. Since the spacers 104 do not extend to the top surface 106 of the pavers, the recesses must likewise not extend to the top surface 112 of the mould 108. Consequently, during filling of the mould 108, it is necessary for the mix 116 to flow laterally within the cavities 110 in order to fill the recesses. This can create difficulties in achieving a sufficient density during compaction. For example, because the mix 116 in the recesses cannot be tamped directly by the tamping plates, the pressure applied to the mix 116 in the recesses is lower than that applied to the bulk of the mix 116 in the body of the paver 100. Again, because the smaller pavers 100 have a greater edge-to-surface area ratio than the larger pavers, the presence of the spacers 104 has a correspondingly greater effect on the geometry of the smaller pavers 100, and so the phenomenon has a magnified effect in smaller pavers 100.

Against this background, it would be desirable to provide a method for manufacturing a plurality of building elements which all of the building elements have comparable mechanical performance.

From a first aspect, the invention resides in a method of filling a mould with a settable material, the mould including a plurality of cavities that open to a top face of the mould.

The method includes providing an additional volume per unit area of settable material to at least part of selected ones of the cavities, and compacting the settable material in at least part of all of the cavities, including the additional volume per unit area of settable material provided to the selected ones of the cavities, to substantially the same thickness.

Providing an additional volume per unit area of settable material can compensate for the tendency of the material to settle and compact to a lower density in cavities of a particular type, compared to the density to which the material settles and packs in other cavities. When the mould is used for the casting of building elements such as pavers or blocks, the invention can be used to improve the strength of the elements that are cast in the selected cavities.

For example, the cavities may be of at least two different sizes, in which case the selected ones of the cavities may have a smaller area in a plane parallel to the top face, relative to other cavities of the plurality. In such a case, the present invention can help ensure that the density, and hence the strength, of small elements made using the mould matches the density and strength of larger elements made using the same mould in the same manufacturing process. Accordingly, the method may include compacting the settable material in at least part of all of the cavities to substantially the same density.

In one example, the method includes providing an excess volume of settable material to the mould, and removing at least a portion of the excess volume from the mould to leave the additional volume per unit area of settable material in at least part of the selected ones of the cavities. In this way, sufficient material is available to allow for settling as the cavities are filled.

A smaller portion of the excess volume of the settable material may be removed from the selected ones of the cavities than from the non-selected cavities. In this way, the additional volume of material per unit area is left in the selected ones of the cavities.

Conveniently, at least a portion of the excess volume is removed from the mould by levelling the settable material in the cavities, for example by scraping. The settable material may be leveled to a first height relative to the top face of the mould in the selected ones of the cavities, while the settable material may be leveled to a second height relative to the top face of the mould in the non-selected cavities. The first height may be greater than the second height. The settable material in the non-selected cavities may, for example, be leveled to the level of the top face of the mould, and/or the settable material in the selected ones of the cavities may be leveled to a height above the top face of the mould.

When the mould includes cavities of more than one size, the tendency of the material to pack to a lower density than desired increases as the size of the cavities is reduced. Accordingly, in one example, the method includes providing a first additional volume per unit area of settable material to at least part of the selected ones of the cavities that are of a first size, and providing a second additional volume per unit area of settable material to at least part of the selected ones of the cavities that are of a second size. Such an arrangement may be useful when the cavities of the plurality are of at least three different sizes.

The present invention is suitable for the manufacture of building elements having uniform thickness across the whole area of the element, such as pavers. Accordingly, the method may include providing the additional volume per unit area to the whole of selected ones of the cavities, and compacting the settable material in all of the cavities to substantially the same thickness.

An embodiment of the present invention therefore resides in a method of filling a mould with a settable material, the mould including a plurality of cavities that open to a top face of the mould. The method includes providing an additional volume per unit area of settable material to selected ones of the cavities, and compacting the settable material in all of the cavities to substantially the same thickness.

The present invention is also suitable for the manufacture of building elements having non-uniform thickness profiles across the area of the element, such as walling blocks that include a rear lip or back lip. Other features that give rise to non-uniform thickness dimensions within an element, such as protrusions, cavities, recesses, weather bars, spacers and so on, can also be accommodated in the context of the invention. In general, when the resulting element does not have uniform thickness across its whole area, the invention can still be applied to a part of the area of each cavity.

Accordingly, in another embodiment, the invention resides in a method of filling a mould with a settable material, the mould including a plurality of cavities that open to a top face of the mould. The method includes providing an additional volume per unit area of settable material to part of selected ones of the cavities, and compacting the settable material in part of all of the cavities, including the additional volume per unit area of settable material provided to the selected ones of the cavities, to substantially the same thickness.

For example, a uniform-thickness region of each cavity may be defined as that part which corresponds to the part of the product resulting from that cavity that has a uniform thickness after compaction (i.e. a region that excludes any recesses or protrusions). An additional volume per unit area of settable material may be provided to the uniform-thickness region of selected ones of the cavities, and the uniform region in all of the cavities may be compacted to substantially the same thickness.

In a second aspect of the invention, there is provided a mould for a settable material, including a plurality of cavities that open to a top face of the mould, wherein the mould includes depth-increasing means that increase the depth of selected ones of the cavities relative to the other cavities. The cavities may be of at least two different sizes, in which case the depth-increasing means may increase the depth of selected ones of the cavities that are smaller than the other cavities.

By virtue of the depth-increasing means, an additional volume of material per unit area can be accommodated in the ones of the selected cavities. The mould of the second aspect of the invention is therefore suitable for use in the method of the first aspect of the invention. Accordingly, the selected ones of the cavities may have a relatively small area in a plane parallel to the top face of the mould, compared to other cavities in the mould.

The depth-increasing means may be provided on the top face of the mould. In this way, the depth-increasing means can cooperate with a scraper or similar device that, in use of the mould, scrapes a settable material from the top face of the mould.

The depth-increasing means may be in the form of a shaped or profiled top surface of the mould. For example, the mould may be provided with a machined top surface profile which is variable in height across the top face of the mould. The depth-increasing means preferably includes one or more rails arranged on the top face of the mould adjacent to the or each selected cavity. For example, the depth-increasing means may include a plurality of parallel rails adjacent to the or each selected cavity. Two parallel rails may be provided on opposite sides respectively of each selected cavity. The rails advantageously provide a surface upon which a part of a scraper or similar device can be lifted or supported, without interfering with the ability of the cavities to receive a settable material in use of the mould.

A top surface of the or each rail may be substantially parallel to the top face of the mould. In this way, the additional volume of material accommodated by the increased depth of the selected ones of the cavities is distributed relatively evenly within the cavity. Alternatively, at least a portion of the top surface of the or each rail may be inclined relative to the top face of the mould. In this case, the additional volume of material can be distributed preferentially in one or more selected areas of the cavity.

The mould may be arranged to cooperate, in use, with a scraper for levelling the settable material. The depth-increasing means may include one or more lift bars disposed in cooperating relationship with at least one rail so as to lift the scraper onto the or each rail, in use. In one example, the or each lift bar extends along top face of the mould in a direction perpendicular to at least one rail.

In a third aspect of the invention, a scraper suitable for levelling a settable material in a mould is provided. The scraper has a bottom edge for scraping a top surface of the mould, and at least a portion of the bottom edge has a shape that is adjustable as the scraper moves in a process direction, in use.

The shape of at least a portion of the bottom edge of the scraper may be adjustable, such that, in use, the scraper leaves an additional volume of settable material in selected areas of the mould. The scraper can be used in this way to provide an additional volume per unit area of material to selected ones of a plurality of cavities in the mould. Accordingly, the scraper of the third aspect of the invention may be used in the method of the first aspect of the invention.

The scraper may include a plurality of segments each having bottom edges, wherein the position of the bottom edge of at least one segment is displaceable relative to the bottom edge of one or more adjacent segments. Advantageously, each such segment can be displaced independently of its neighbours, so that the scraper can level adjacent areas of the mould to different heights. The segments may be in the form of plates.

The plurality of segments may be arranged in a common plane, and at least one segment may be moveable out of the common plane to allow displacement of the position of bottom edge of the segment.

The at least one segment is flexible to allow displacement of the position of its bottom edge. For example, the at least one segment may be of a rubber material.

The scraper may include a support to which the segments are mounted. The at least one segment may be pivotally mounted to the support to allow displacement of the position of its bottom edge. Alternatively, at least one segment may be arranged for reciprocal movement relative to the support to allow displacement of the position of the bottom edge of the at least one segment.

Preferably, the at least one segment is resilient to return to a starting position after displacement of its bottom edge. In this way, the scraper can be used to provide an additional volume of material per unit area to the mould along only a portion of its travel in the process direction.

The scraper may include actuating means to effect adjustment of the shape of the at least a portion of the bottom edge.

Alternatively, the scraper may be arranged to cooperate with lifting means provided on a mould to effect adjustment of the shape of the at least a portion of the bottom edge. For example, the scraper may be arranged to cooperate with the depth-increasing means of a mould according to the second embodiment of the invention, wherein the depth-increasing means provide lifting means for the scraper.

Accordingly, a fourth aspect of the invention resides in the combination of a mould according the second aspect of the invention and a scraper according to the third aspect of the invention. In such a combination, the scraper cooperates with the depth-increasing means to effect adjustment of the shape of the bottom edge of the scraper.

Preferred and/or optional features of each aspect of the invention may also be provided, alone or in appropriate combination, in the other aspects of the invention.

Reference has already been made to FIGS. 1 to 3 of the accompanying drawings, in which:

The present invention will now be described, by way of example only, with reference to the remaining accompanying drawings, in which like reference numerals are used for like features, and in which:

FIG. 4 is a perspective view of a mould according to an embodiment of the invention;

FIG. 5 is a perspective view of a first intermediate step in a method according to the invention, using the mould of FIG. 4 and a scraper according to another embodiment of the invention;

Figure 5:
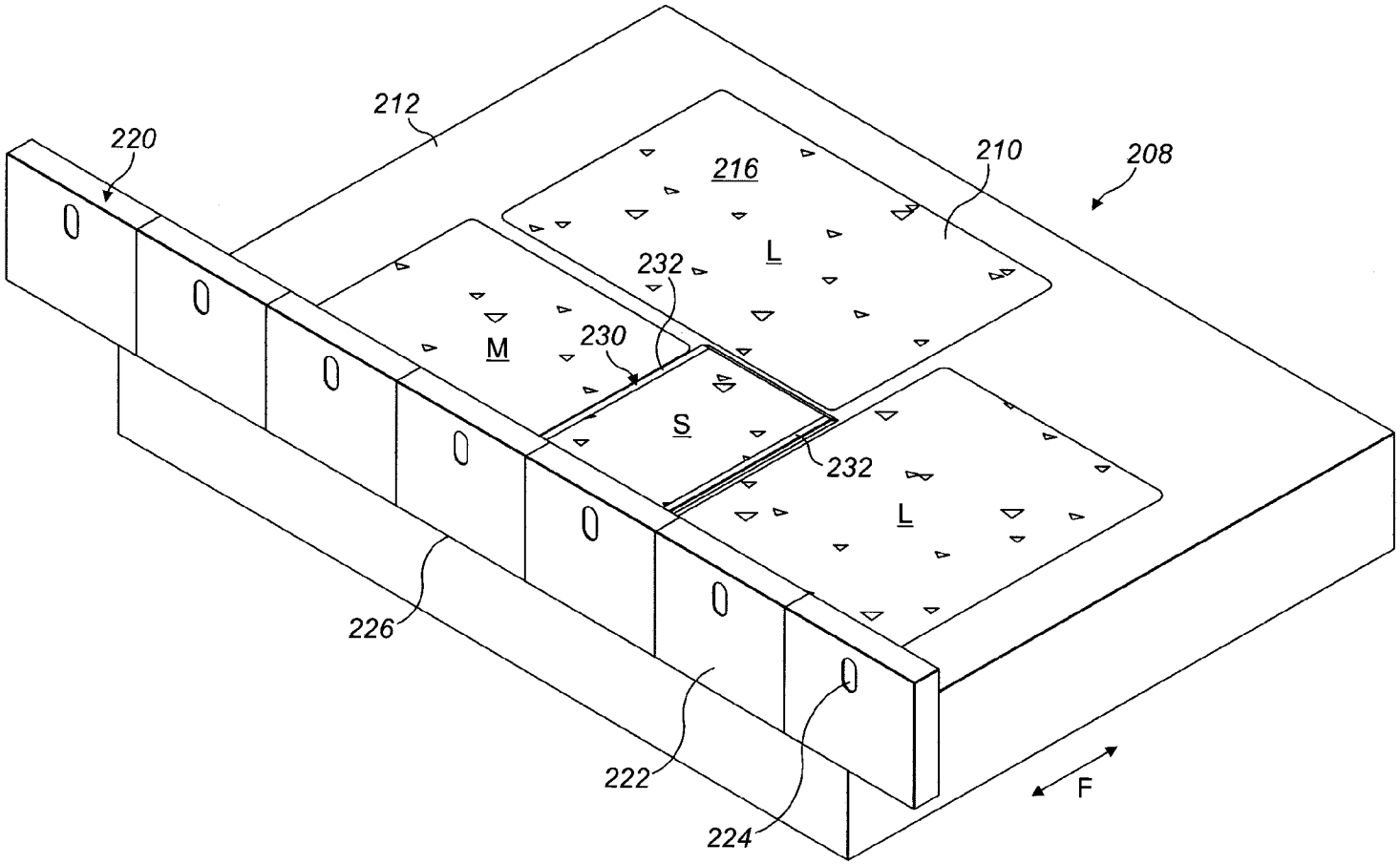
Figure 6A:
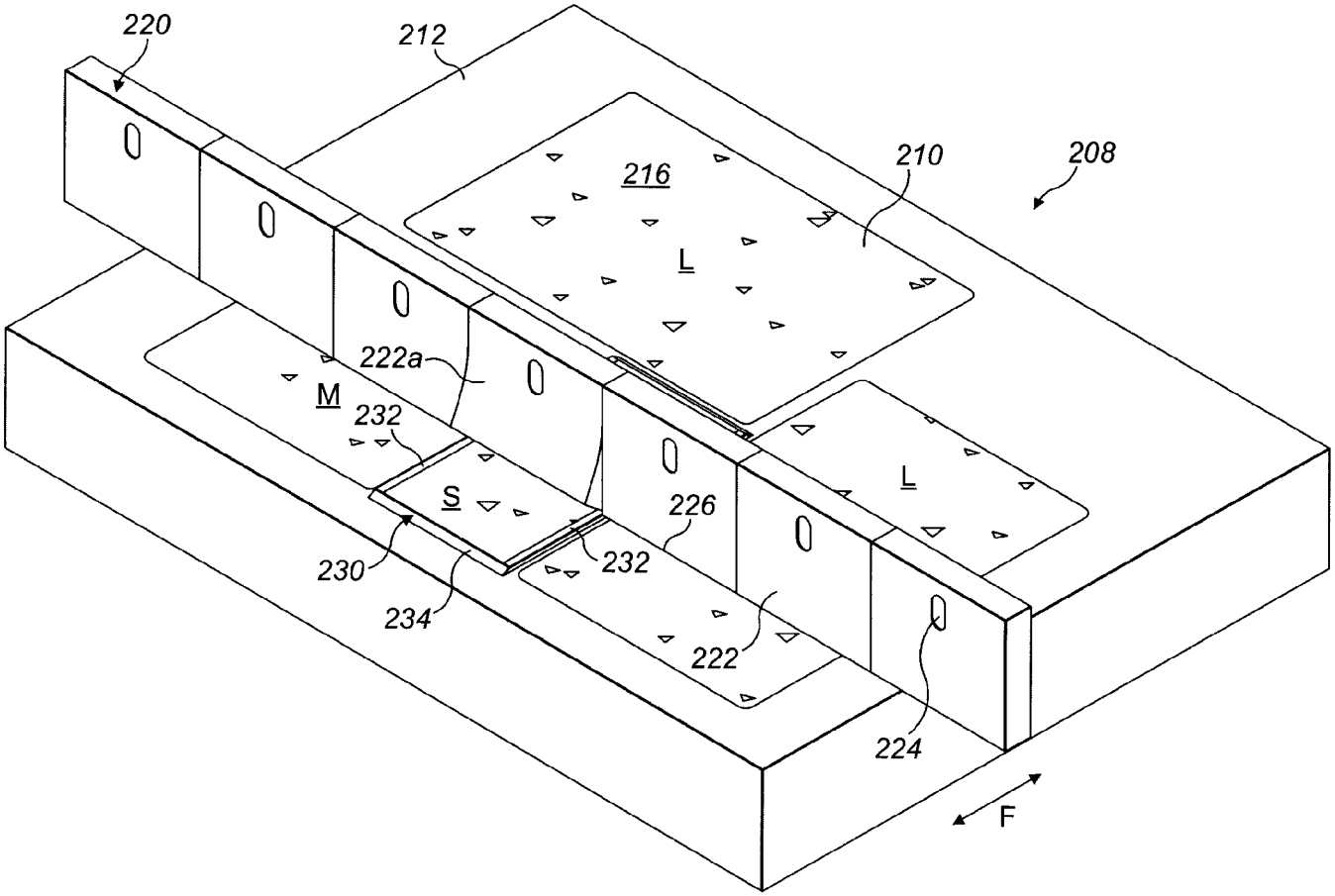
Figure 6B:
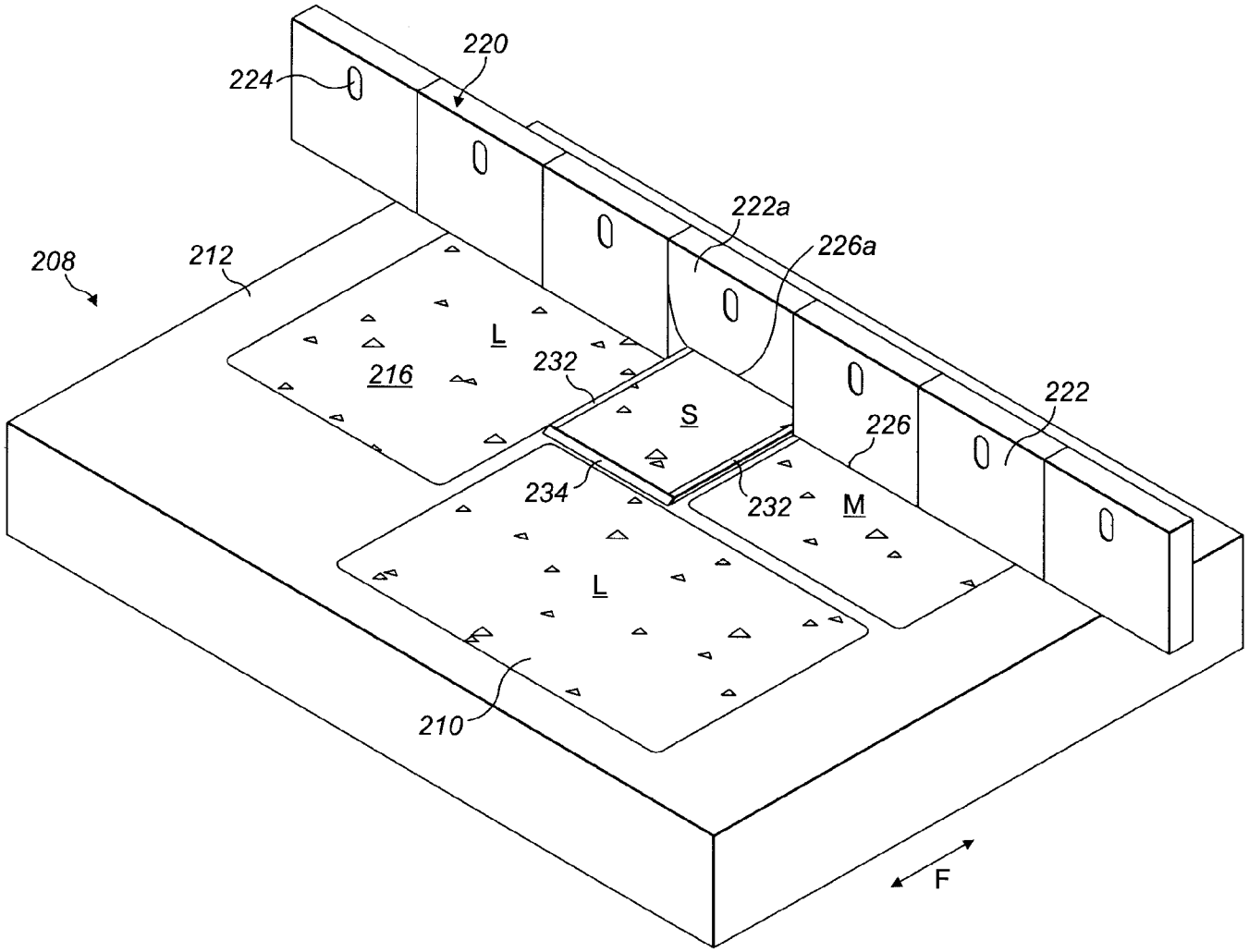
Figure 7:
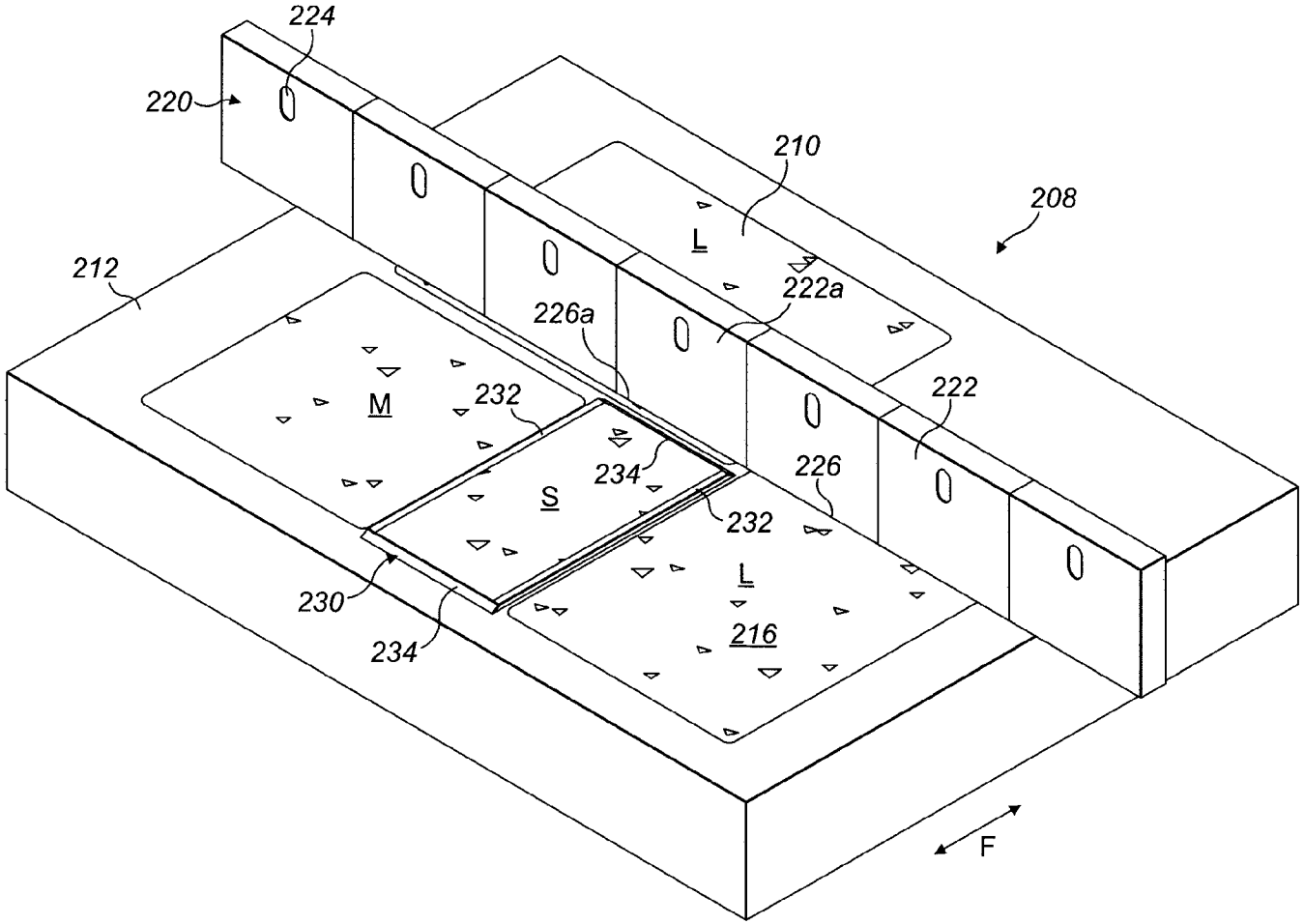
Figure 8:
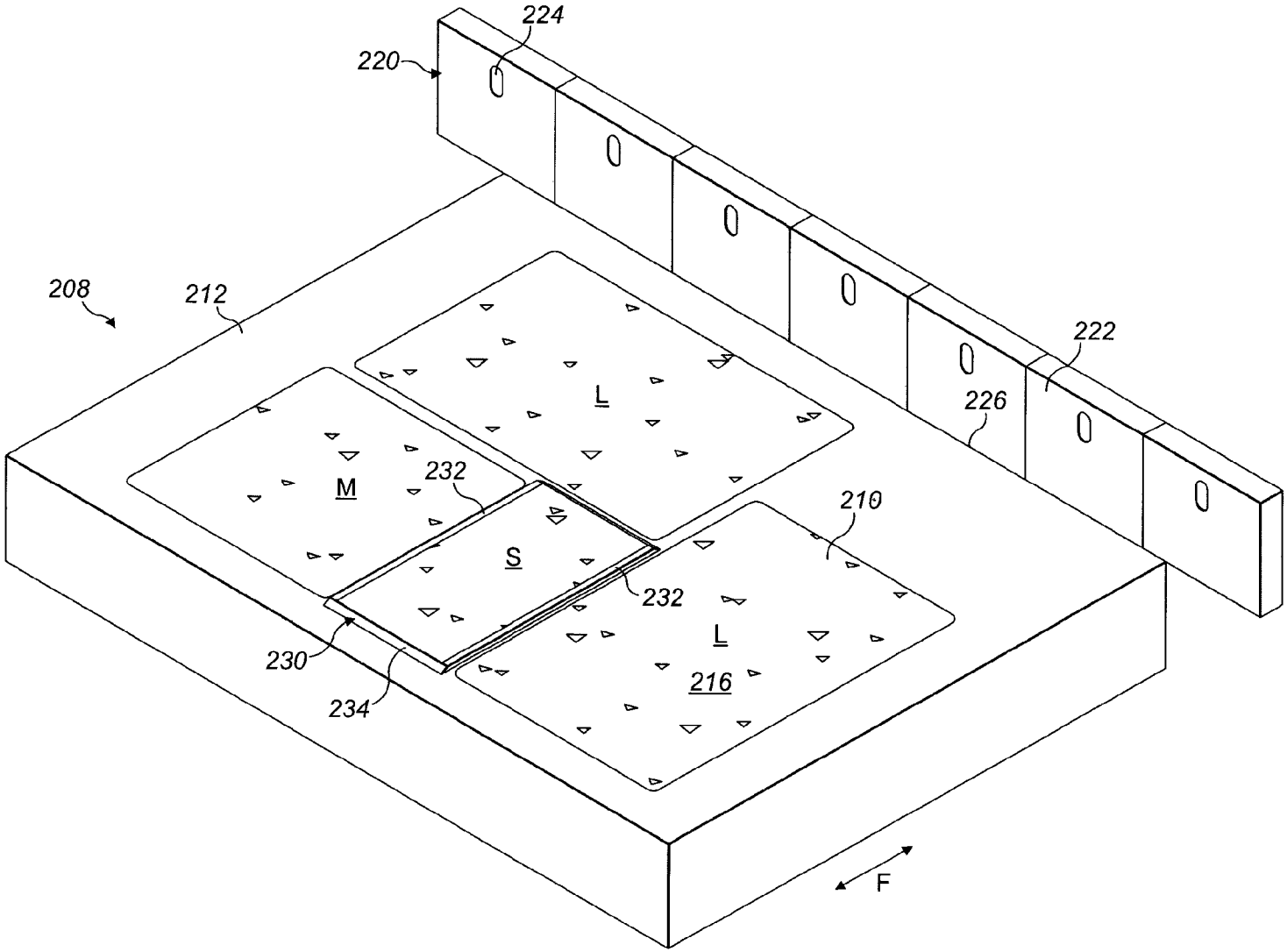
Figure 9:
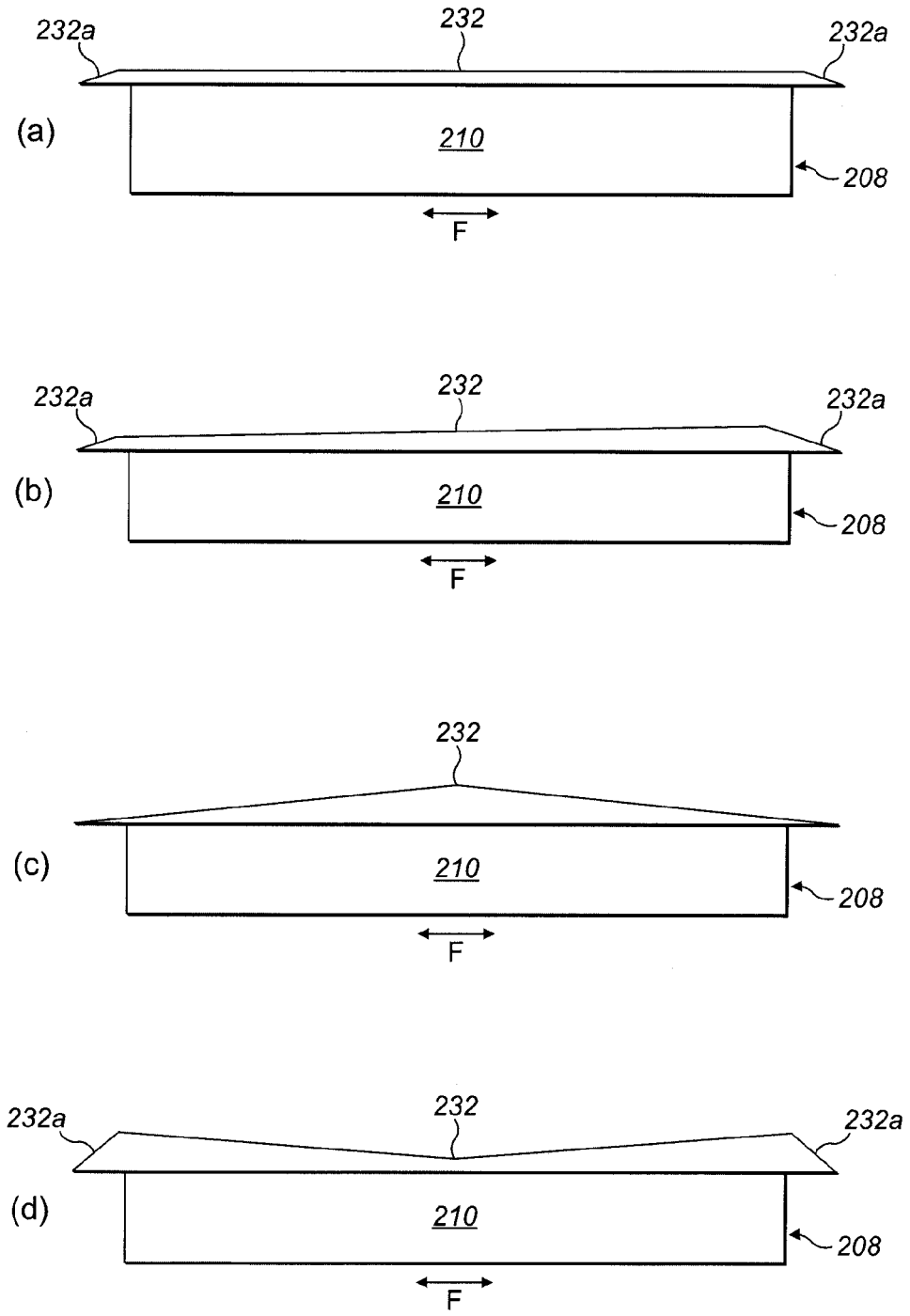
Figure 10:
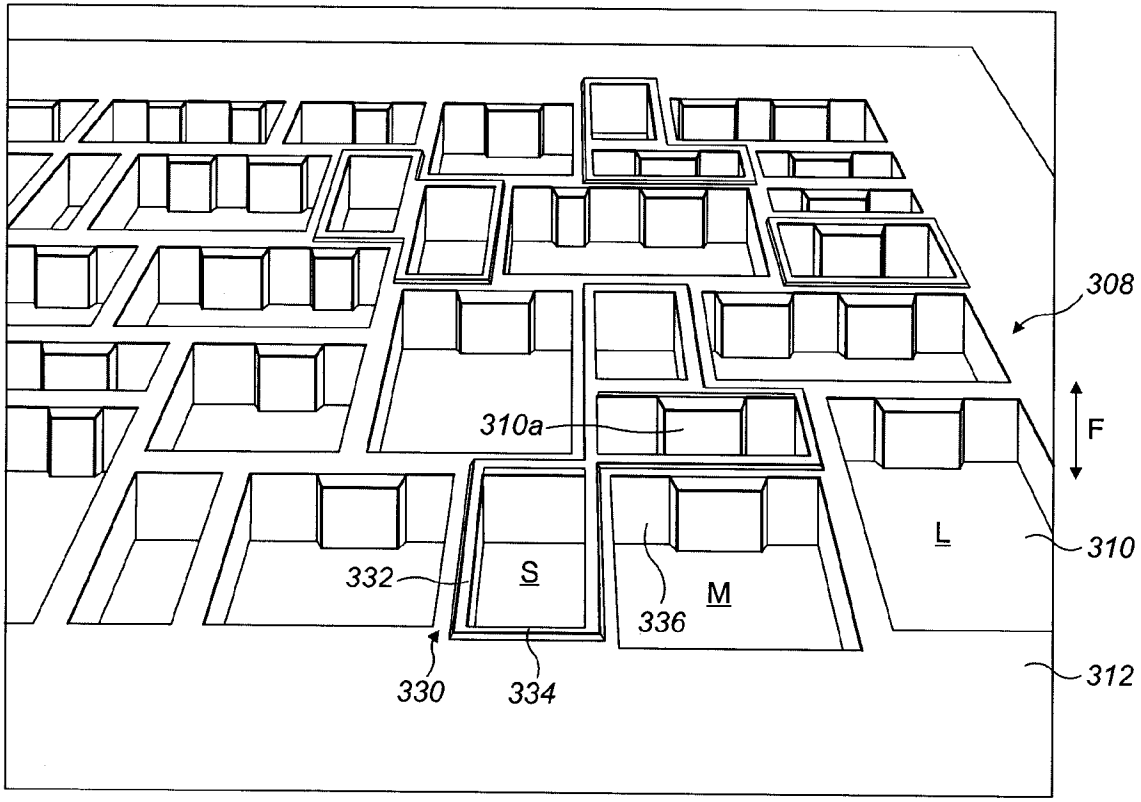
Figure 11:
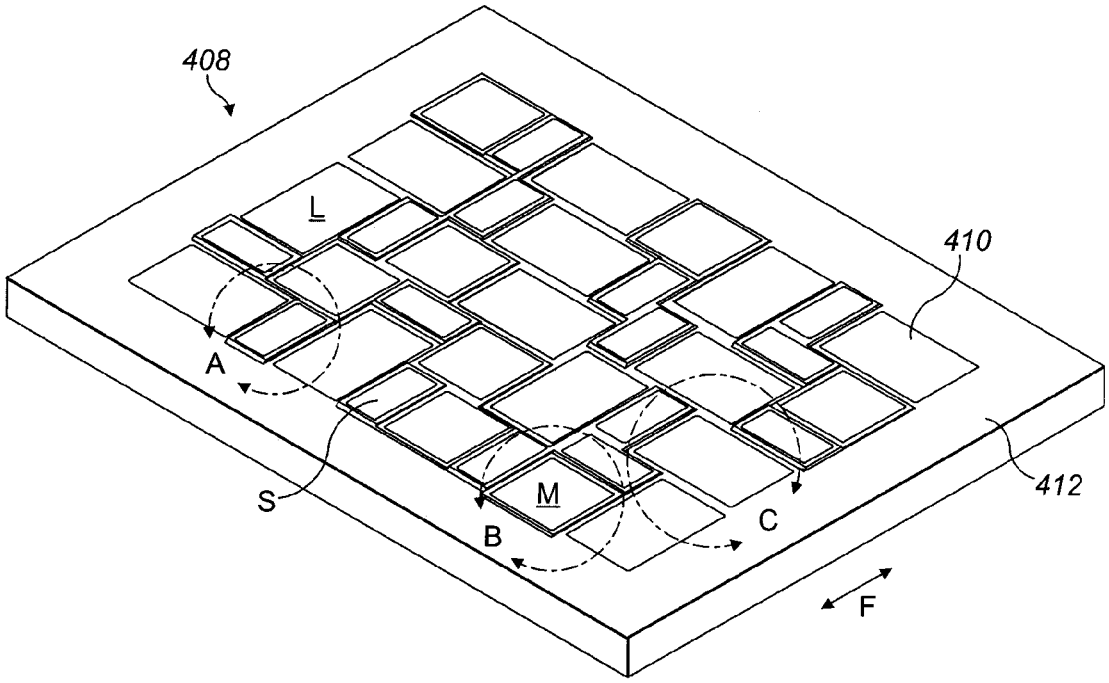
Figure 12A:
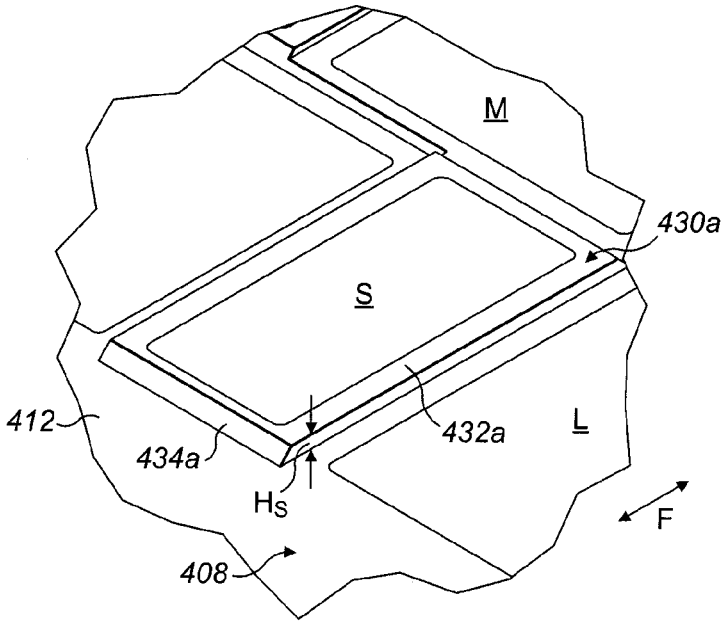
Figure 12B:
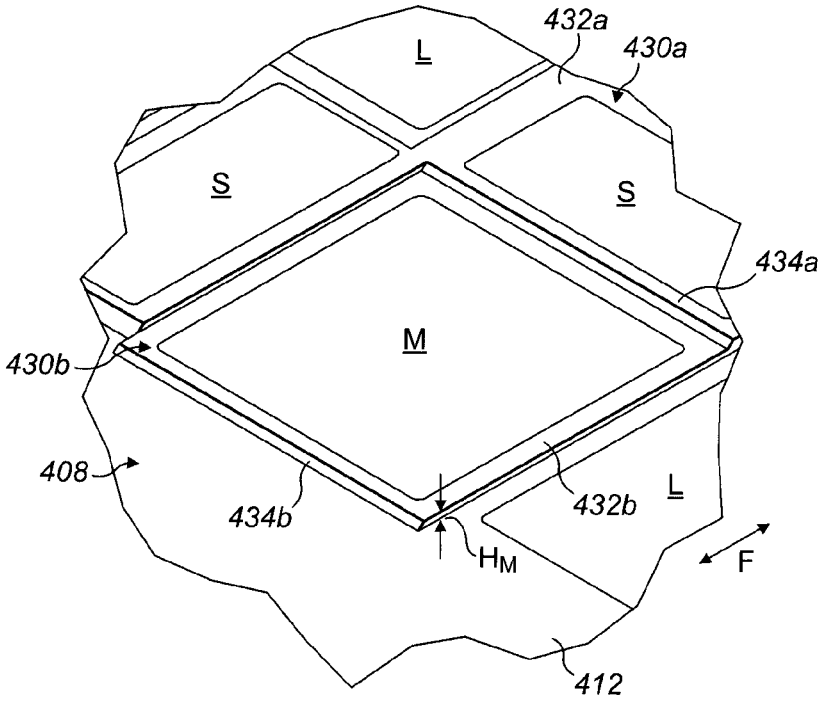
Figure 12C:
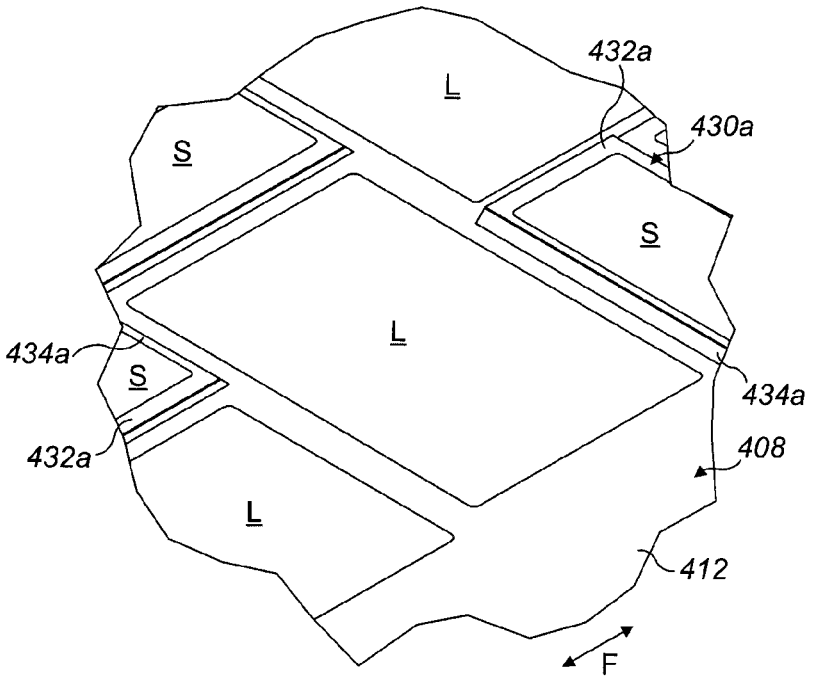
Figure 13:
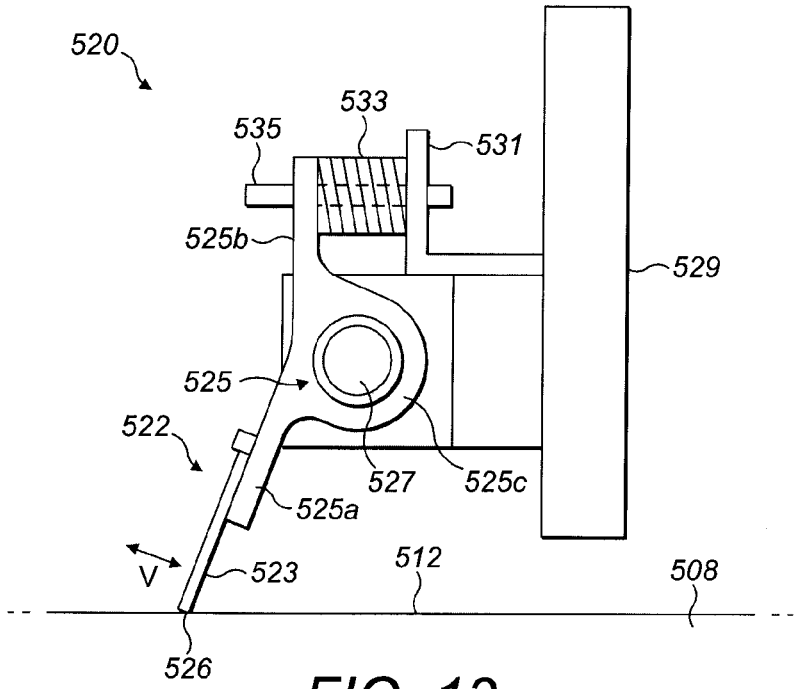
Figure 14:
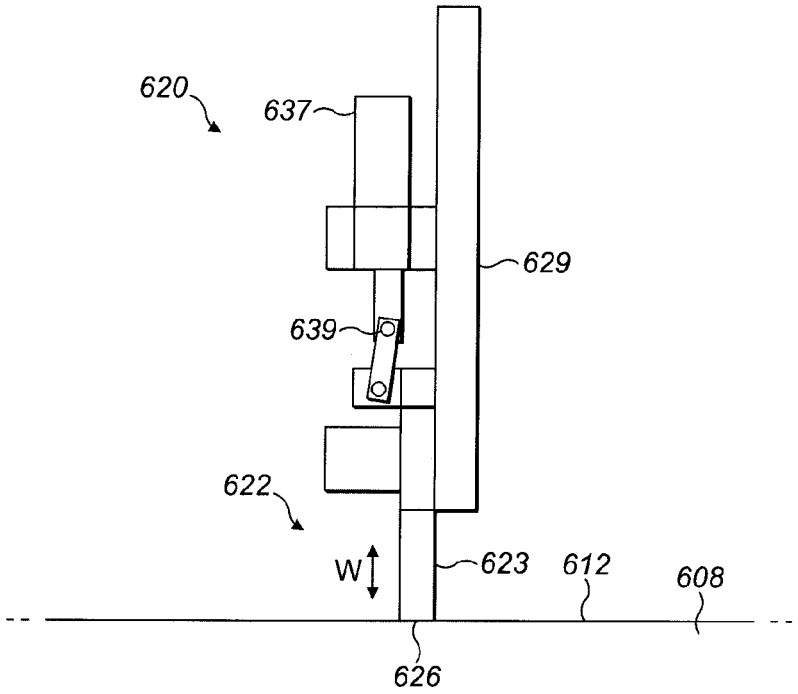

FIGS. 6(*a*) and 6(*b*) are perspective views of a subsequent intermediate step in the method illustrated in FIG. 5, from two different angles;

FIG. 7 is a perspective view of a further subsequent intermediate step in the method illustrated in FIG. 5;

FIG. 8 is a perspective view of a yet further subsequent intermediate step in the method illustrated in FIG. 5;

FIGS. 9(*a*) to 9(*d*) are side sectional views of parts of moulds according to further embodiments of the invention;

FIG. 10 is a perspective view of a mould according to another embodiment of the invention;

FIG. 11 is a perspective view of a mould according to a further embodiment of the invention;

FIGS. 12(*a*), 12(*b*) and 12(*c*) are enlarged views of the areas marked A, B and C respectively in FIG. 11;

FIG. 13 is a side sectional view of part of a scraper according to another embodiment of the invention; and FIG. 14 is a side sectional view of a part of a scraper according to still another embodiment of the invention.

Figure 4:
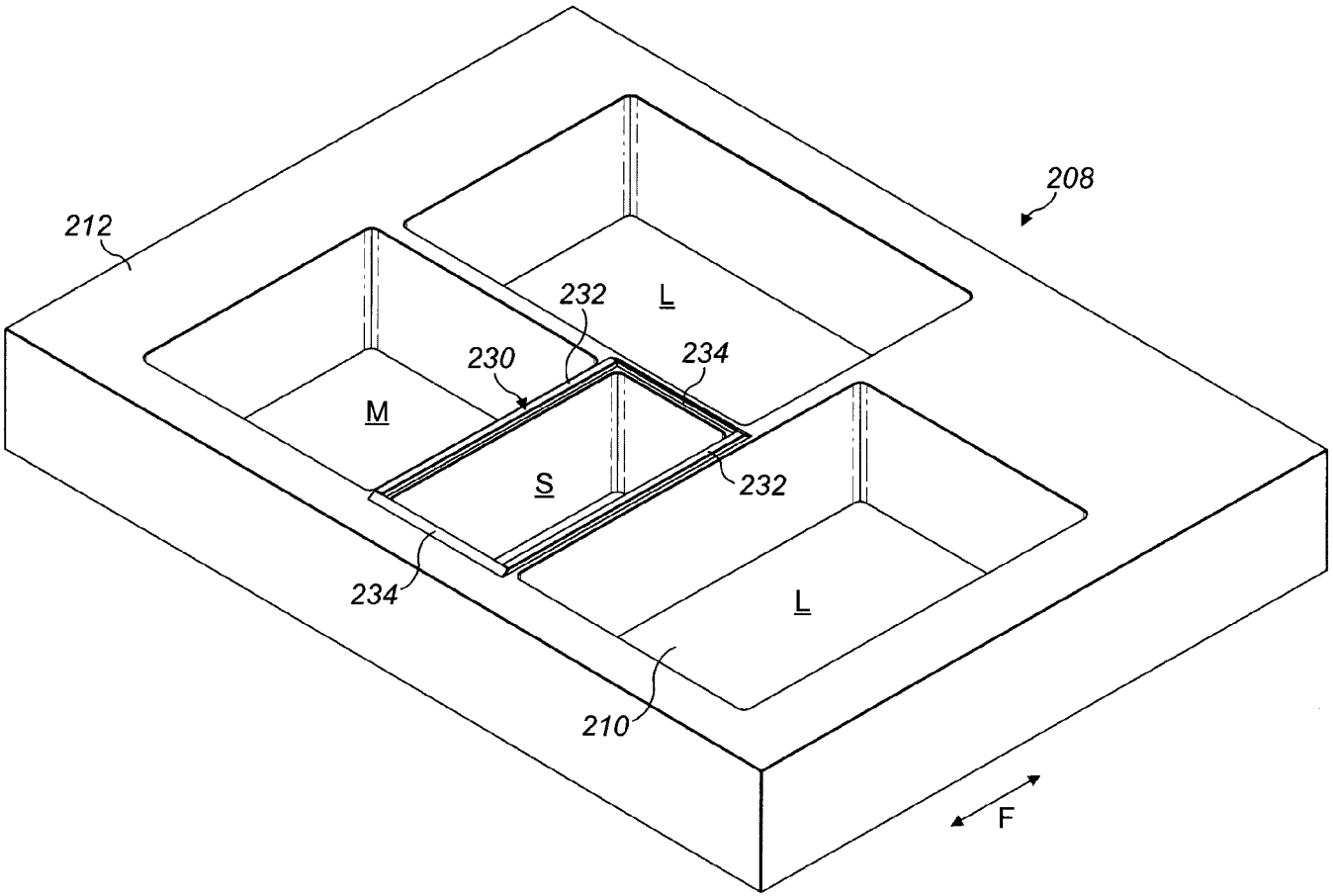

A mould according to the present invention is shown in FIG. 4. The mould 208 includes a plurality of cavities 210 for receiving a cementitious casting mix. For clarity, only four cavities 210 are shown in FIG. 4, but in reality a greater number of cavities 210 would be provided in an arrangement suitable for casting a set of block-like pavers such as that shown in FIGS. 1 and 2 and described above.

The plurality of cavities 210 includes cavities of several different sizes. In FIG. 4, two large cavities (labelled "L"), one medium-sized cavity (labelled "M") and one small cavity (labelled "S") are shown.

The top face 212 of the mould is generally planar, except for a region surrounding the small cavity S, which is provided with lifting means in the form of a raised frame 230. The frame 230 includes two spacer bars or rails 232 arranged on opposite sides of the cavity S and orientated parallel to a filling direction (indicated by the arrow F in FIG. 4). The frame 230 is completed by two lift bars 234, extending between the rails 232 in a direction perpendicular to the filling direction F. The lift bars 234 are arranged on opposite sides of the cavity S.

The cavities 210 also open to the bottom surface of the mould (not shown in FIG. 4). In use, the bottom surface of the mould rests on a pallet or similar device (not shown), so that the bottom of each cavity 210 is closed. In this way, each cavity 210 can receive and retain a quantity of cementitious casting mix.

Figure 3:
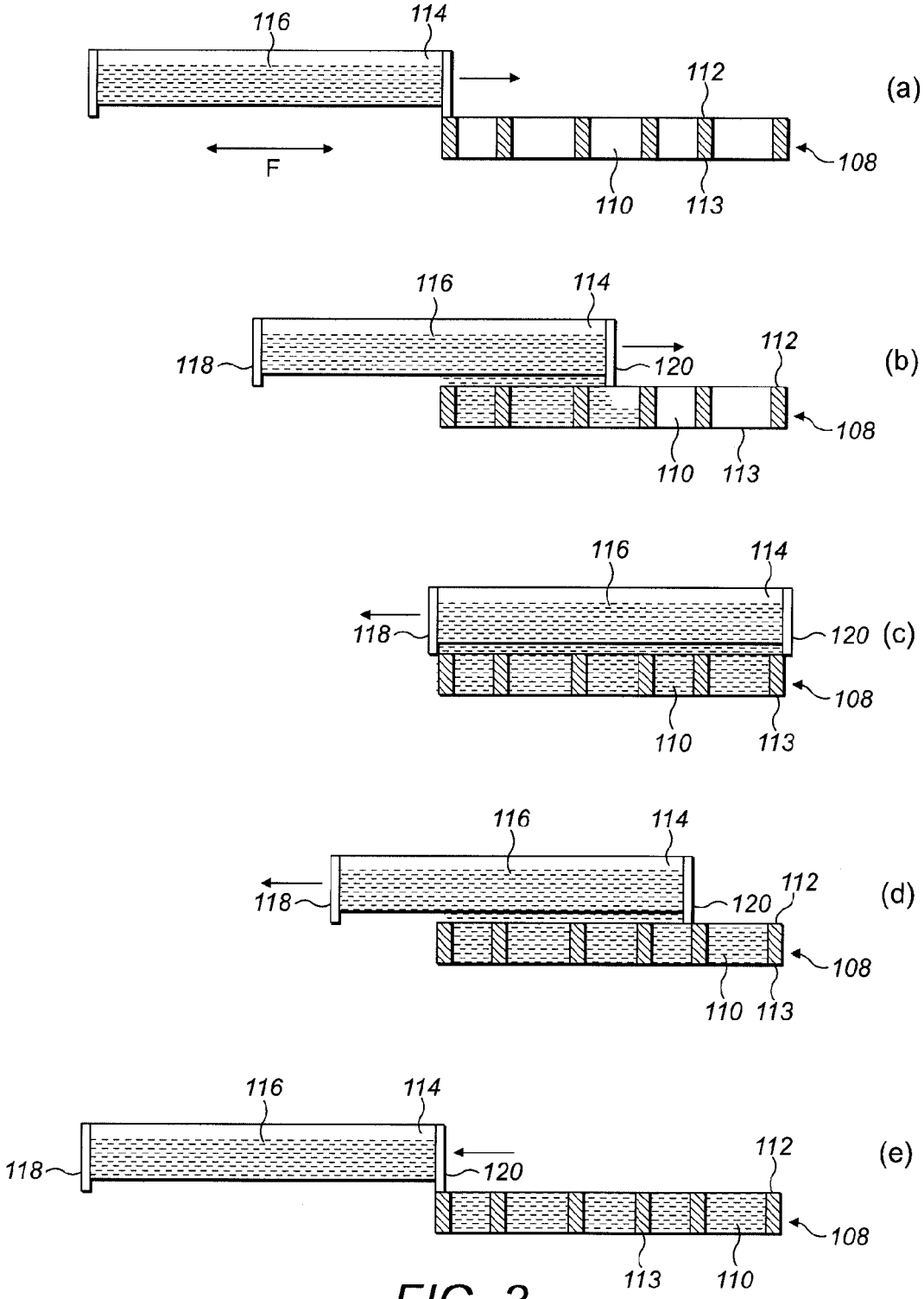
FIG. 3 shows, schematically, a sequence of steps in a known manufacturing process suitable for manufacturing a set of pavers such as that shown in FIGS. 1 and 2.

The mould 208 is filled using a process as described with reference to FIG. 3, using a feed drawer that receives the casting mix from a hopper. According to the invention, however, the feed drawer is equipped with a scraper having a modified form, as will now be described.

One scraper 220 according to the invention is shown in FIG. 5. For clarity, the feed drawer is not shown in FIG. 5, but it will be understood that a scraper 220 of the type shown in FIG. 5 is mounted to the front edge of the feed drawer.

The scraper 220 according to the invention includes a plurality of sections or segments 222 arranged in a common plane. Each segment 222 is made from a relatively flexible rubber material, such as natural rubber, and is mounted to the feed drawer by suitable fastening means that pass through mounting holes 224 in each segment.

As explained with reference to FIG. 3, the feed drawer is moveable back and forth with respect to the mould 208 in a filling direction F. When the feed drawer is positioned above the mould 208, the casting mix 216 is transferred to the cavities 210 and to the top surface 212 of the mould 208.

FIG. 5 shows an intermediate stage in the manufacturing process, in which the feed drawer (not shown) is positioned above the mould 208 and in which mix 216 fills the cavities 210. Additionally, excess mix is present on the top surface 212 of the mould 208, both directly on top of, and on the top surface 212 between, the cavities 210. The excess mix is not shown in FIG. 5 for clarity. A retaining scraper (not shown) is attached to the rear edge of the feed drawer so that the mix is retained between the scraper 220 and the retaining scraper. The retaining scraper can be of conventional form.

The scraper 220 is positioned so that the bottom edge 226 of each segment 222 is in contact with the top surface 212 of the mould 208. When the feed drawer moves in the filling direction, the scraper 220 slides across the top surface 212 to remove at least a portion of the excess mix from the mould 208, and to level the mix 216 in the cavities.

The segments 222 of the scraper 220 are dimensioned to match the spacing between the rails 232 of the frame 230 around the small cavity S. As shown in FIGS. 6(*a*) and 6(*b*), when the scraper 220 reaches the first lift bar 234 of the frame 230, one of the segments 222*a* is caused to deform by bending so that the segment 222*a* can pass over the lift bar 234. In this way, the bottom edge 226*a* of the segment 222*a* is lifted above the surface of the mould 208. Said another way, the bottom edge of the scraper 220, formed by the bottom edges 226 of the adjacent segments 222, changes shape to accommodate the lift bar 234.

As the scraper 220 continues to travel across the mould 208, the peripheral regions of the bottom edge 226*a* of the deformed segment 222*a* ride along the rails 232 of the frame 230. In this way, the bottom edge 226*a* of the deformed segment 222*a* remains above the level of the surface of the mould 208. As a result, the mix 216 in the small cavity S is leveled to a height corresponding to the height of the mould 208 plus the height of the frame 230.

Once the scraper 220 passes the second lift bar 234, adjacent the far edge of the small cavity S, the deformed segment 222*a* is able to return to its original shape, in line with the adjacent segments 222. This is shown in FIG. 7. The bottom edge 226 of the scraper 220 thus returns to a straight configuration, and the scraper 220 continues to level the mix 216 in the remaining cavities 110 to the height of the top surface 212 of the mould 208.

Movement of the feed drawer continues until the scraper 220 reaches the edge of the mould 208, as shown in FIG. 8.

During the filling process, the mix 216 settles in the cavities. The mould 208 may also be vibrated to help packing and compaction of the mix 216. As the mix 216 settles, the level of the mix may drop from the top surface 212 of the mould 208 or, in the case of the small cavity S, from the top surface of the frame 230. If necessary, the feed drawer can be passed back over the mould 208 so as to top up the level of the mix 216 in the cavities 210. It will be appreciated that the respective segment 222*a* of the scraper 220 will lift as the scraper 220 passes in either direction over the frame 230.

After filling in this way, the small cavity S contains a greater volume, or additional volume, of mix 216 per unit area than the larger cavities L, M. In other words, by virtue of the frame 230, the depth of the mix 216 in the small cavity S is greater than the depth of the mix 216 in the larger cavities L, M. The lifting means or frame therefore acts as a depth-increasing means for the small cavities. The frame causes a smaller portion of the excess volume of the mix 216 to be removed from the small cavity S by the scraper than from the larger cavities L, M.

The mix 216 in each of the filled cavities 210 is tamped by a suitable tamping device (not shown). The tamping device includes a plurality of tamping shoes corresponding to each cavity 210 that compact and compress the mix 216 so that the height of the mix 216 in each cavity 210 becomes substantially the same. While the tamping shoes are still in place atop the mix 216 in each cavity, the mould 208 is lifted upwards from the pallet. The tamping shoes are then lifted to leave the self-supporting, compacted blocks of mix 216 on the pallet. The blocks are then cured to form the finished pavers.

As noted above, the mix 216 tends to fill to a lower density in the small cavities S than in the larger cavities M, L. By virtue of the invention, however, the small cavities S contain an additional volume of material per unit area to compensate for this lower filling tendency. As a result, after tamping and compaction, the density of the mix 216 in the small cavities S is comparable to the density of the mix 216 in the larger cavities M, L. Consequently, the mechanical performance of the small pavers is consistent with the mechanical performance of the larger pavers produced in the same process. In particular, the small pavers are less prone to damage at their edges and corners, since the presence of the additional volume of material forces the material to pack densely into the corners and edges of the respective cavities.

It may be desirable to influence the distribution of the additional volume of material within a single cavity 210. It will be appreciated that the distribution of the additional volume of material is influenced by the position of the top surface of the respective rail 232 relative to the top face of the mould.

In some circumstances, it is preferred that the additional volume of material is applied uniformly across the area of the cavity 210. This can be achieved by providing rails 232 having a uniform thickness, as shown in cross-section in FIG. 9(*a*). As can also be seen in FIG. 9(*a*), the rails 232 may include ramp portions 232*a* at each end, in order to help the segments 222 of the scraper 220 ride up onto the rails 232. The ramp portions 232*a* may instead be part of the lift bars 234.

FIG. 9(*b*) shows an alternative arrangement, in which the rails 232 are generally wedge-shaped. In this case, more additional volume of material would be deposited towards the end of the cavity 210 closest to the thick end of the wedge shape than towards the end of the cavity 210 closest to the thin end. Such an arrangement may be useful in ensuring that the resulting paver has a uniform density in situations where, for processing reasons not associated with the lifting means, the material tends to settle or compact more densely at one end of the cavities 210 than at the other end.

FIG. 9(*c*) shows another alternative arrangement, in which each rail 232 increases in thickness moving from the ends of the rail towards its centre. In this case, the additional material is distributed preferentially towards the middle of the cavity 210. In this example, ramp portions are not required.

FIG. 9(*d*) shows yet another alternative arrangement, in which each rail 232 decreases in thickness moving from the ends of the rail 232 towards its centre. In this case, the additional material is distributed preferentially towards the ends of the cavity 210.

It will be appreciated that, by the provision of suitably shaped rails 232, other distributions of the additional material within a cavity 210 could be achieved. Furthermore, it may be desirable to provide additional material to selected parts of every cavity in the mould using shaped rails 232 such as those shown in FIGS. 9(*b*), 9(*c*) and 9(*d*).

Figure 1:
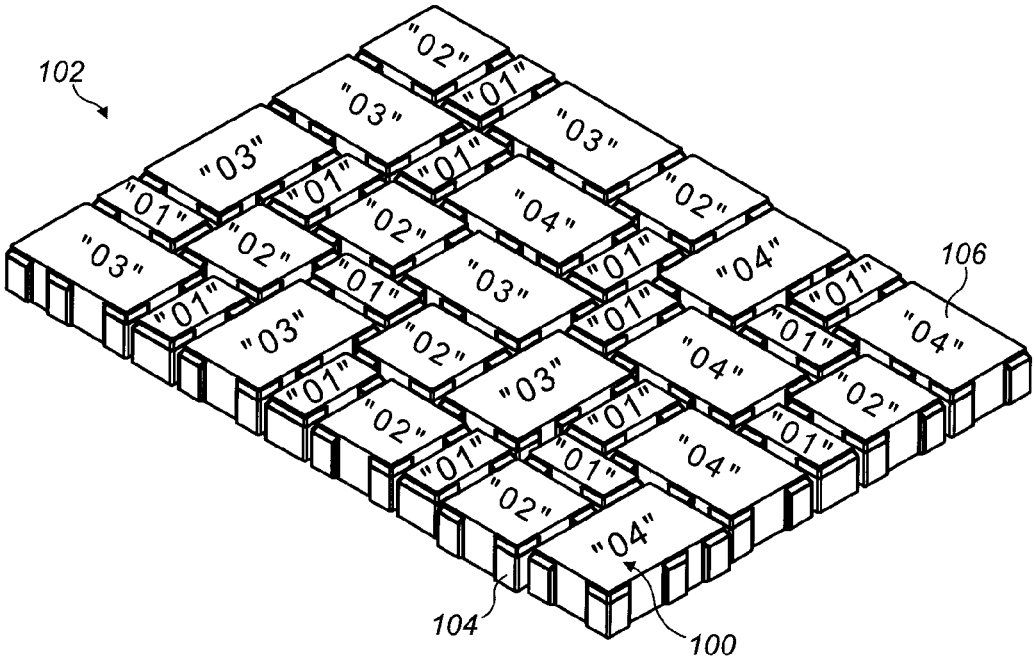
FIG. 1 is a perspective view of a set of pavers having different sizes and arranged in a pattern suitable for installation.
Figure 2:
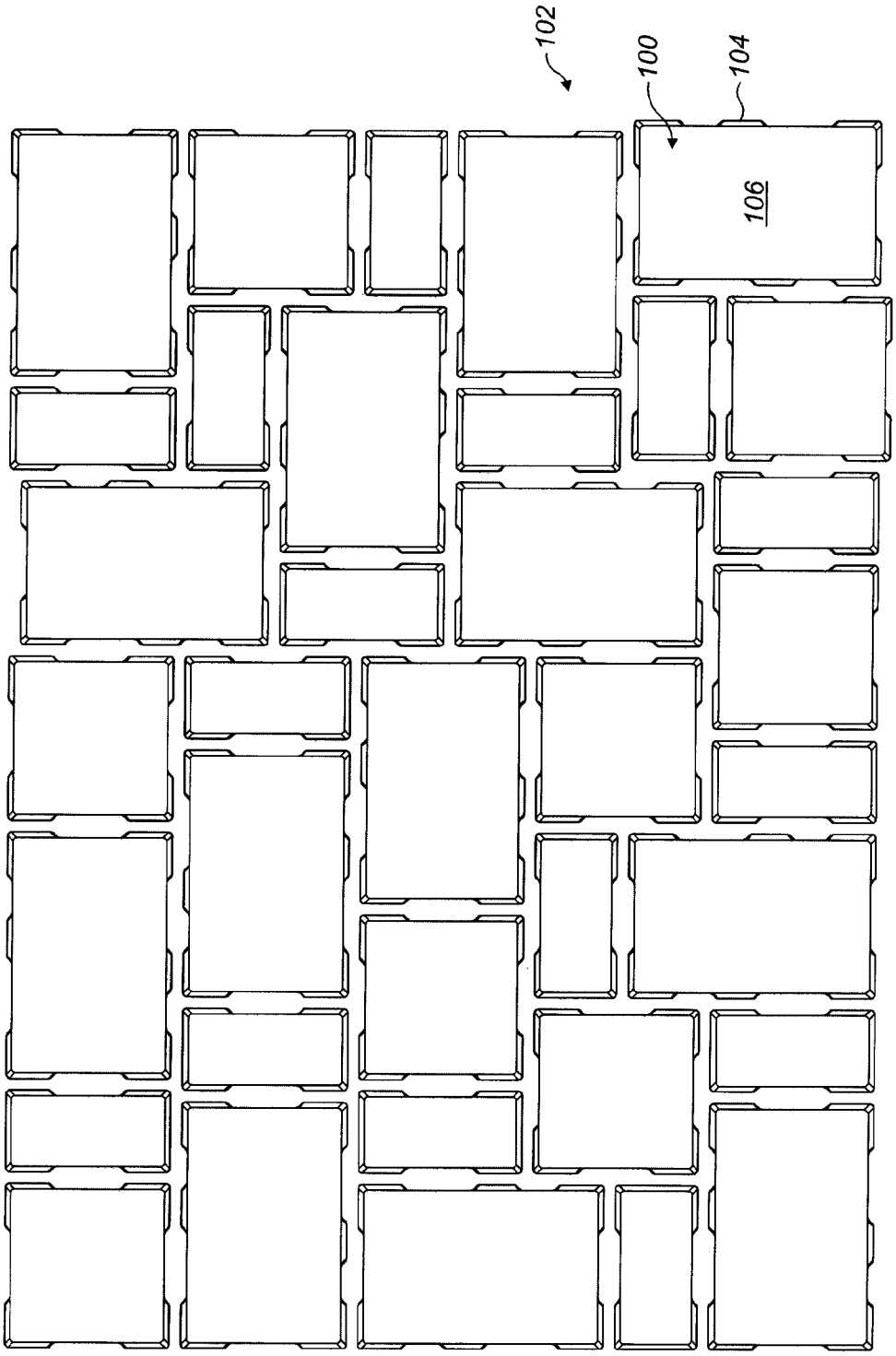
FIG. 2 is a top view of the set of pavers of FIG. 1.

A set of pavers such as that shown in FIGS. 1 and 2 can be produced using the above-described method and apparatus, using a suitably-shaped mould. FIG. 10 is a perspective view of part of such a mould 308, which is similar to the mould 208 described above with reference to FIG. 4.

The mould 308 comprises several cavities 310 of each of small (S), medium (M) and large (L) sizes. A frame 330, consisting of rails 332 and lift bars 334, is provided on the top surface 312 of the mould 308 around each small cavity S. Recesses 336 are provided in the walls of the cavities 110, to form the spacers 104 on the walls of the pavers 100.

The mould 308 can be manufactured by fixing rails 332 and lift bars 334 to the top surface 312 of a conventional mould in the appropriate locations, for example by welding. The rails 332 and/or the lift bars 334 could instead be formed integrally with the rest of the mould 308 during its fabrication.

A set 102 of pavers 100 as shown in FIGS. 1 and 2 can be produced using the mould 308 and a suitable scraper 220 as previously described.

It will be appreciated from FIG. 10 that two adjacent segments 222 of the scraper 220 will be lifted when the scraper 220 encounters a small cavity S that is oriented with its longest edge parallel to the scraper 220. One such cavity is labelled 310*a* in FIG. 10. In this case, each segment rides along only one rail 322. The material of the segments 222 is stiff enough so that the bottom edge of each lifted segment does not droop downwards towards the cavity 310*a*.

For comparison, a set 102 of pavers 100 was manufactured using a mould with the same arrangement of cavities as the mould 308 shown in FIG. 10, but with lifting means provided for only some of the small cavities S. The wet density (i.e. the mass of the compacted blocks of mix after removal from the mould divided by the volume of the compacted mix) of the pavers 100 was measured.

The wet density of the pavers cast in the small cavities S without lifting means was approximately 94% of the wet density of the pavers cast in the medium-sized cavities M, and approximately 93% of the wet density of the pavers cast in the large-sized cavities L.

In contrast, the wet density of the pavers cast in the small cavities S with lifting means, in accordance with the invention, was approximately 103% of the wet density of the pavers cast in the medium-sized cavities M, and approximately 102% of the wet density of the pavers cast in the large-sized cavities L. Use of the present invention therefore significantly increases the packing of material in the small cavities S compared to the larger cavities M, L, resulting in improved mechanical properties of small pavers 100 produced in accordance with the invention compared to small pavers produced by conventional means.

In the embodiments described above, only the small cavities S of the moulds are provided with lifting means. It will be appreciated, however, that the casting mix will also tend to pack to a lower density in the medium-sized cavities M than in the large cavities L, albeit that the phenomenon will occur to a lesser degree than in the small cavities S.

Accordingly, in a further embodiment of the invention, lifting means may also be provided around the medium-sized cavities M, so as to ensure that the density of the resulting medium pavers is consistent with the density of the large pavers. A suitable mould 408 is shown in FIG. 11 and in FIGS. 12(*a*) to (*c*).

In this embodiment, the mould 408 includes a plurality of cavities 410 of small (S), medium (M) and large (L) sizes, arranged in the configuration required to cast a set 102 of pavers 100 as shown in FIGS. 1 and 2. The mould 408 is suitable for use in a manufacturing process as described above, using a scraper of the type shown in FIG. 5. The mould is shown in FIGS. 11 to 12(*d*) in an intermediate stage of a manufacturing process in which the cavities 410 of the mould have been filed with a casting mix of cementitious material, and in which the mixture has been leveled by the action of the scraper.

As shown most clearly in FIG. 12(*a*), which is an enlarged view of the area marked 'A' in FIG. 11, lifting means in the form of frames 430*a* are provided on the top face 412 of the mould 408 around each of the small cavities S. As in previous embodiments, each frame 430*a* includes two rails 432*a* on opposite sides of the cavity S, extending in a direction parallel to the direction F in which the feed drawer moves, and two lift bars 434*a*, also on opposite sides of the cavity S but extending in a direction perpendicular to the direction F (that is, parallel to the plane of the scraper in use).

In use of the mould 408, the frames 430*a* cause displacement of segments of the scraper as they pass over the small cavities S, so that the bottom edges of the segments are lifted to a height $H_S$ above the top face 412 of the mould 408.

As shown in FIG. 12(*b*), which is an enlarged view of the area marked 'B' in FIG. 11, lifting means in the form of frames 430*b* are also provided around each of the medium-sized cavities M. Like the frames 430*a* around the small cavities S, the frames 430*b* around the medium-sized cavities M are made up of rails 432*b* and lift bars 434*b*.

In use, the frames 430*b* cause displacement of the segments of the scraper as they pass over the medium-sized cavities M so that the bottom edges of the segments are lifted to a height $H_M$ above the top face 412 of the mould 408. The height $H_M$ is less than the height $H_S$ to which the bottom edges of the scraper segments are lifted as they pass over the small cavities S.

As shown in FIG. 12(*c*), which is an enlarged view of the area marked 'C' in FIG. 11, there are no frames around the large cavities L. Therefore, as the segments of the scraper pass over the large cavities, the bottom edges of the segments slide along the top face 412 of the mould.

Because of the difference in the heights of the frames 430*a*, 430*b*, the additional volume of material per unit area provided to the small cavities S of the mould 408 is larger than the additional volume of material per unit area that is provided to the medium-sized cavities M. In this way, the tendency for the mix to compact to a lower density as the size of the cavities 410 decreases can be accurately compensated for, and the density of the pavers produced from the mould 408 is effectively independent of the size of the pavers.

In the above-described embodiments of the invention, the application of an additional volume per unit area of material to selected cavities is achieved by cooperation of flexible segments of a scraper bar with lifting means provided on the top surface of the mould. It will be understood, however, that the effect of the invention could be achieved using different apparatus.

For example, it is conceivable that the method of the present invention could utilise a conventional mould, with no lifting means. In such a case, the scraper may incorporate actuating means to lift or displace the segments according to the pattern of cavities in the mould, to fill the mould with additional material where desired. When actuating means are provided, the segments of the scraper may have dimensions substantially less than the width of the cavities of the mould.

The actuating means could be one or more electronically controlled actuators such as motors or solenoids, or one or more hydraulic or pneumatic actuators, for example. One or more actuators could be associated with each segment of the scraper. The layout of the mould could be pre-programmed into a controller of the actuators, and the controller could be arranged to displace the necessary segments at the appropriate time as the scraper passes over the mould.

In one alternative, for example, the scraper comprises a plurality of rigid plates that are pivotally mounted on a support rod or bar. The plates are arranged so that individual plates can ride up on the rails of the lifting means, and then drop down again to contact the top face of the mould when the plate moves away from the lifting means. The plates may be biased to return to their original position, for example by being spring loaded or suitably weighted.

By way of illustration, FIG. 13 shows a scraper 520 of an alternative embodiment of the invention in side view. The scraper 520 includes a plurality of segments 522, one of which is shown in FIG. 13. Each segment 522 includes a rigid plate 523 mounted to a corresponding lever 525. Each lever 525 has a lower arm 525*a*, to which the plate 523 is mounted, an upper arm 525*b*, and a pivot mounting 525*c*. Each lever 525 is pivotally mounted to a support rod 527, by way of the pivot mounting 525*c*, so that each lever 525 can turn about the support rod 527 in the direction indicated by arrow V.

The support rod 527 is mounted to a scraper support 529. The scraper support 529 may optionally be attached to a feed drawer (not shown).

An upstanding bracket 531 is provided on the scraper support 529 so that a face of the bracket 531 opposes a face of the upper arm 525*b* of the lever 525. A compression spring 533 is provided between the bracket 531 and the upper arm 525*b* so as to bias the upper arm 525*b* away from the bracket 531. A guide pin 535 extends from the bracket 531 through a vertically-extending slot (not shown) in the upper arm 525*b*. The arrangement of the guide pin 535 and the slot is such that turning movement of the lever 525 about the slot is possible, but side-to-side movement of the lever 525 is prevented. The guide pin 535 retains the spring 533.

The scraper support 529 is positioned such that, in use of the scraper, a bottom edge 526 of each plate 523 is biased against the top face 512 of the mould 508 due to the action of the spring 533. In this way, the plates 523 act to scrape excess material from the top face 512 of the mould, as previously described.

The bottom edge 526 of each plate 523 can be lifted above the top face 512 of the mould 508 in order to leave additional material in a selected cavity by using lifting means (not shown) on the top face 512 of, or otherwise associated with, the mould 508 as previously described. When a plate 523 reaches the lifting means, the lever 525 turns in a clockwise direction to lift the bottom edge 526 of the plate 523. When the plate 523 leaves the lifting means, the lever 525 is caused to turn in an anticlockwise direction by the action of the spring 533 to lower the bottom edge 526 of the plate 523.

In a variation of the scraper shown in FIG. 13, an actuator is provided between each bracket 531 and each corresponding upper arm 525*b*. Each actuator controls the position of the bottom edge 526 of the corresponding plate 523.

In another alternative, the scraper comprises a plurality of segments that are arranged to reciprocate in a vertical direction. Upward movement of a plate is caused by the bottom edge of the plate rides up onto the rails of the lifting means.

Again, the scraper could instead include actuators for effecting upward movement of the plates without the use of lifting means. FIG. 14 is a side view of one segment 622 of such a scraper 620. The segment 622 includes a vertical plate 623 mounted for reciprocal vertical movement with respect to a scraper support 629. A linear motion actuator 637 is attached to the scraper support 529. The actuator 637 is connected to the plate 623 by way of a linkage 639. The actuator 637 is operable to lift and lower the plate 623 relative to the scraper support 629. In this way, by operation of the actuators 623, the bottom edges 626 of the plates 623 can be raised and lowered with respect to the top face 612 of a mould 608 in use of the scraper, so as to provide an additional amount of material to the mould 608 where desired.

In the above-described embodiments, the feed drawer moves relative to the mould. However, it is also conceivable that the mould could move relative to the feed drawer. A scraper according to the invention could be provided on each side of the feed drawer, so that the feed drawer could move back and forth across the mould between respective starting positions on each side of the mould.

It may be desirable that a scraper according to the invention is placed in contact with the mould only at certain stages of the filling process. For example, it may be desirable to ensure that the scraper moves only in one direction with respect to the mould. In other words, it may be desirable to lift the scraper during a pass of the feed drawer across the mould in a first direction, and to lower the scraper onto the top face of the mould during a pass of the feed drawer in a second, opposite direction. In another example, when the feed drawer makes more than one pass over the mould, it may be desirable that the scraper according to the invention is only placed in contact with the mould for the final pass.

To this end, a scraper according to the invention may be operable to move the scraper into and out of contact with the top face of the mould. For example, the scraper may be mounted to a support assembly that can raise the scraper so that its bottom edge clears the top face of the mould, and lower the scraper back on to the mould when required so that scraping occurs. Such a system could be used in combination with a conventional scraper, so that the mould is scraped by a conventional scraper during some stages of the mould-filing operation and by a scraper according to the invention during other stages.

Instead of a feed drawer as described above, the cementitious material could be provided to the cavities by other filling means, such as by feed tubes or by manual means. In such a case, a scraper according to the invention could be mounted to a suitable scraper holder that moves relative to the mould, or that is fixed relative to a moveable mould.

Whilst the examples given above relate to compensating for filling density variations due to size differences between building elements in a set, filling density variations can also occur for other reasons. For example, when cavities of the same size but with different orientations relative to the filling direction are included in a mould, cavities of a particular orientation may tend to fill to a lower density than those of another orientation. Filling density variations may also arise due to the shape of the cavities, the arrangement of the cavities in the mould, the presence and arrangement of spacer-forming recesses in the mould, the spacing between the cavities, the position of the cavities relative to the edges of the mould, the flow behaviour of the settable material in the feed drawer and around the mould, localised differences in the agitation and vibration behaviour of the mould-filling apparatus, uneven charging of the feed drawer, and so on.

As will be appreciated, the present invention may be used to compensate for filling density variations in these cases also, by providing additional material to appropriate selected cavities and/or to appropriate parts of selected cavities.

Furthermore, it will be understood that the scraper of the present invention is not limited to use in a method to compensate for filling density variations. By adjusting the shape of the bottom edge of the scraper as the scraper passes over the mould, for example by lifting or otherwise displacing segments of the scraper, additional material can be provided to selected parts of some or all of the cavities so as to define recesses, bars and other such features. As will be appreciated, in such cases, the tamping device used to compact the material after filling is suitably shaped to preserve the features.

Although the present invention has been described with reference to cementitious material, it is equally applicable to other settable, compactable materials, particularly those having a relatively high viscosity and relatively large aggregate or particle sizes.

The present invention is not limited to the manufacture of building elements for surface coverings. The invention can be used to manufacture building elements such as blocks, slabs and tiles for use in many other applications, such as for cladding, retaining walls, architectural masonry, decorative masonry, roofing, and so on.

The present invention is not limited to the manufacture of building elements having uniform thickness across the whole area of the element. For example, building elements for retaining walls may include a region of increased thickness in the form of a bar extending across the width of the element on its undersurface. This feature is known in the art as a rear lip or back lip. When laid in a retaining wall, the back lip of an element engages with the back upper corner of an element in the adjacent row below, thereby providing a mechanical engagement to increase the retention capability of the wall.

The present invention can be adapted to produce such elements, for example by providing a tamping shoe that is profiled to mould the back lip during compaction of the material. In this method, an additional volume per unit area of settable material would be provided to part of selected ones of the mould cavities, and then the settable material in part of all of the cavities, including the additional volume per unit area of settable material provided to the selected ones of the cavities, would be compacted to substantially the same thickness.

Said another way, parts of each of the cavities corresponding to the parts of the elements that are to have the same thickness after manufacturing would be compacted to substantially the same thickness during the compaction stage. Additional settable material would be provided beforehand to the parts of the selected cavities where required, to compensate for packing density variations between the cavities before compaction.

Other features that give rise to non-uniform thickness dimensions within an element, such as protrusions, cavities, recesses, weather bars, spacers and so on, can also be accommodated in the context of the invention. In general, when the resulting element does not have uniform thickness across its whole area, the invention can still be applied to a part of the area of each cavity.

The present invention is applicable to several types of casting process, and is not limited to use in the manufacture of building elements. For example, as well as the process described above, in which the blocks of compacted cementitious material are removed from the mould after compaction, the invention would also offer a benefit in a process in which the blocks of compacted cementitious material remain in the mould as they harden or cure.

It will be appreciated that many other variations and modifications not explicitly described above are also possible without departing from the scope of the invention as set forth in the appended claims.

The invention claimed is:

1. A method of filling a mould with a settable material using an apparatus that includes the mould comprising at least a first cavity and a second cavity, each cavity being open to a top face of the mould, a scraper comprising at least a plurality of displaceable segments, and a mechanism that produces selective upward displacement of at least one segment of the scraper while simultaneously not displacing other segments of the scraper, the method comprising:

over filling the first cavity and the second cavity with the settable material, the first cavity being smaller than the second cavity;

moving the scraper across the top face of the mould;

upwardly displacing at least one first segment as the first segment passes over the first cavity while simultaneously not upwardly displacing at least one second segment as the second segment passes over the second cavity so that a height of a bottom edge of the first segment is above a height of a bottom edge of the second segment; and achieving a desired material density and thickness of the settable material in the first cavity and the second cavity by a selective use of vibration or tamping or both.

2. The method of claim 1, wherein the mechanism comprises at least one rail arranged on the top face of the mould adjacent an edge of the first cavity.

3. The method of claim 2, wherein the first segment deforms as the first segment passes over the at least one rail.

4. The method of claim 2, wherein the first segment is pivotally mounted to a support rod of the scraper so that the first segment pivots upward as the first segment passes over the at least one rail.

5. The method of claim 2, wherein the settable material in the first cavity is leveled to a first height, and the settable material in the second cavity is leveled to a second height, wherein the first height is greater than the second height, wherein the second height is substantially aligned with the top face of the mould.

6. The method of claim 5, wherein the first height is substantially aligned with a top surface of the at least one rail.

7. The method of claim 1, the mould further comprising at least a third cavity, the method further comprising:

over filling the third cavity with the settable material;

upwardly displacing at least one third segment as the third segment passes over the third cavity so that a height of a bottom edge of the third segment is below the height of the bottom edge of the first segment and above a height of the bottom edge of the second segment;

achieving a desired material density and thickness of the settable material in the third cavity by a selective use of vibration or tamping or both.

8. The method of claim 7, wherein the first cavity is smaller than the third cavity, and the third cavity is smaller than the second cavity.

9. The method of claim 1, wherein the mechanism comprises one or more actuators.

10. The method of claim 9, wherein the one or more actuators are electronically controlled.

11. The method of claim 9, wherein the one or more actuators are hydraulic or pneumatic.

12. A method of filling a mould with a settable material using an apparatus that includes the mould comprising at least a first cavity and a second cavity, each cavity being open to a top face of the mould, a scraper comprising at least a plurality of displaceable segments, and a mechanism that produces selective upward displacement of at least one segment of the scraper while simultaneously not displacing other segments of the scraper, the mechanism comprising at least one rail arranged on the top face of the mould adjacent an edge of the first cavity; the method comprising:

over filling the first cavity and the second cavity with the settable material;

moving the scraper across the top face of the mould;

upwardly displacing at least one first segment as the first segment passes over the first cavity while simultaneously not upwardly displacing at least one second segment as the second segment passes over the second cavity so that a height of a bottom edge of the first segment is above a height of a bottom edge of the second segment, the first segment deforming as the first segment passes over the at least one rail; and achieving a desired material density and thickness of the settable material in the first cavity and the second cavity by a selective use of vibration or tamping or both.

13. The method of claim 12 wherein the step of over filling includes overfilling the first cavity and the second cavity with the settable material, in which the first cavity is smaller than the second cavity.

* * * * *